US008900071B2

(12) United States Patent
Kii

(10) Patent No.: US 8,900,071 B2
(45) Date of Patent: Dec. 2, 2014

(54) PUTTER TYPE GOLF CLUB HEAD AND PUTTER TYPE GOLF CLUB

(75) Inventor: Kenji Kii, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 239 days.

(21) Appl. No.: 13/534,071

(22) Filed: Jun. 27, 2012

(65) Prior Publication Data

US 2013/0005503 A1 Jan. 3, 2013

(30) Foreign Application Priority Data

Jun. 28, 2011 (JP) ..... 2011-143089

(51) Int. Cl.
*A63B 53/04* (2006.01)

(52) U.S. Cl.
CPC ..... *A63B 53/0487* (2013.01); *A63B 2053/0429* (2013.01)
USPC ..... 473/332; 473/340; 473/342; 473/349

(58) Field of Classification Search
USPC ..... 473/324–350, 287–292, 251–256
See application file for complete search history.

(56) References Cited

U.S. PATENT DOCUMENTS

| | | | | | |
|---|---|---|---|---|---|
| 4,422,638 | A | * | 12/1983 | Tucker | 473/329 |
| 5,083,778 | A | * | 1/1992 | Douglass | 473/329 |
| 5,332,214 | A | * | 7/1994 | Tucker, Sr. | 473/329 |
| 5,458,332 | A | * | 10/1995 | Fisher | 473/251 |
| 5,542,675 | A | * | 8/1996 | Micciche et al. | 473/329 |
| 5,674,132 | A | * | 10/1997 | Fisher | 473/290 |
| 5,766,093 | A | * | 6/1998 | Rohrer | 473/329 |
| 5,766,094 | A | * | 6/1998 | Mahaffey et al. | 473/342 |
| 5,921,871 | A | * | 7/1999 | Fisher | 473/329 |
| 6,001,030 | A | * | 12/1999 | Delaney | 473/329 |
| 6,083,117 | A | * | 7/2000 | Hsu | 473/332 |
| 6,200,229 | B1 | * | 3/2001 | Grace et al. | 473/324 |
| 6,217,460 | B1 | * | 4/2001 | Broadbridge et al. | 473/324 |
| 6,302,807 | B1 | * | 10/2001 | Rohrer | 473/329 |
| 6,431,997 | B1 | * | 8/2002 | Rohrer | 473/324 |
| 6,699,140 | B1 | * | 3/2004 | Sun | 473/252 |
| 6,729,972 | B2 | * | 5/2004 | Boord | 473/340 |
| 6,863,620 | B2 | * | 3/2005 | Tucker, Sr. | 473/288 |
| 7,134,971 | B2 | * | 11/2006 | Franklin et al. | 473/340 |
| 7,273,420 | B2 | * | 9/2007 | Wright | 473/329 |
| 7,341,527 | B1 | * | 3/2008 | Fisher | 473/329 |
| 7,500,923 | B2 | * | 3/2009 | Tateno | 473/329 |

(Continued)

FOREIGN PATENT DOCUMENTS

| | | | |
|---|---|---|---|
| JP | 8-196668 | A | 8/1996 |
| JP | 2004-236985 | A | 8/2004 |

*Primary Examiner* — Sebastiano Passaniti
(74) *Attorney, Agent, or Firm* — Birch, Stewart, Kolasch & Birch, LLP

(57) ABSTRACT

A putter type golf club head 1 having a face 2 for hitting a ball on a front side has a head main body 1A provided in a face 2 side with a concave portion 3 and a face insert 1B made of an elastic material attached to the concave portion 3 of the head main body 1A. The face insert 1B has a three-layered structure composed of a first layer 8 disposed in a frontmost side, a third layer 10 disposed in a rearmost side and a second layer 9 sandwiched between the first layer 8 and the third layer 10, wherein hardnesses h1, h2 and h3 and moduli of repulsion elasticity r1, r2 and r3 of the first layer 8, second layer 9 and third layer 10, respectively, satisfy relationships: h1>h2, h3>h2, r1>r2 and r3>r2.

20 Claims, 5 Drawing Sheets

(56) References Cited

U.S. PATENT DOCUMENTS

| | | | | |
|---|---|---|---|---|
| 7,641,569 | B2 * | 1/2010 | Best et al. | 473/329 |
| 7,824,278 | B2 * | 11/2010 | Miyamichi | 473/329 |
| 8,083,611 | B2 * | 12/2011 | Kuan et al. | 473/340 |
| 8,109,841 | B2 * | 2/2012 | Miyamichi | 473/340 |
| 8,292,754 | B2 * | 10/2012 | Snyder et al. | 473/251 |
| 8,480,513 | B2 * | 7/2013 | Kuan et al. | 473/329 |
| 8,622,850 | B2 * | 1/2014 | Narita et al. | 473/329 |
| 2005/0009623 | A1 * | 1/2005 | Dickinson | 473/329 |
| 2007/0099723 | A1 * | 5/2007 | Tateno | 473/340 |
| 2007/0099724 | A1 * | 5/2007 | Tateno | 473/340 |
| 2007/0099725 | A1 * | 5/2007 | Tateno | 473/340 |
| 2007/0149311 | A1 * | 6/2007 | Wright et al. | 473/329 |
| 2011/0319188 | A1 * | 12/2011 | Narita et al. | 473/329 |
| 2012/0108357 | A1 * | 5/2012 | Nakamura | 473/329 |
| 2012/0149492 | A1 * | 6/2012 | Del Rosario et al. | 473/340 |
| 2012/0196700 | A1 * | 8/2012 | Rollinson | 473/342 |
| 2013/0005500 | A1 * | 1/2013 | Narita | 473/329 |
| 2013/0005503 | A1 * | 1/2013 | Kii | 473/340 |

* cited by examiner

PUTTER TYPE GOLF CLUB HEAD AND PUTTER TYPE GOLF CLUB

BACKGROUND OF THE INVENTION

The present invention relates to a putter type golf club head and a putter type golf club in which stable ball rolling distances and directions can be obtained.

In recent years, as a putter type golf club head, a head in which a face insert made of an elastic material is disposed in a concave portion of a metal head main body has been known. In such a putter type golf club head, soft impact feelings can be obtained.

Heretofore, in order to make the impact feelings of a putter softer, a face insert in which an elastomer is used as an elastic material has been proposed in Japanese Patent Application Publication No. H08-196668. If a soft face insert is used, however, there is a possibility that the ball launch direction is slightly deviated (deterioration of directionality) or undesirable additional spins occur.

In order to solve the above-mentioned problems, it has been proposed in Japanese Patent Application Publication No. 2004-236985 that a face insert is provided with a two-layered structure, and a relatively hard elastic material is used in a face side thereof. In such a putter type golf club head, however, it is difficult to obtain a soft impact feeling.

SUMMARY OF THE INVENTION

In light of the above-explained circumstances, the present invention was made and intends to provide a putter type golf club head and a putter type golf club in which, by forming a face insert as a three-layered structure and defining the hardness and the modulus of repulsion elasticity of each of the layers, stable ball rolling distances and directions can be obtained, while ensuring good soft impact feelings.

According to the present invention, a putter type golf club head has a face for hitting a ball on a front side, wherein the head has a head main body provided in a face side with a concave portion, and a face insert made of an elastic material attached to the concave portion of the head main body, the face insert has a three-layered structure made up of a first layer disposed in a frontmost side, a third layer disposed in a rearmost side and a second layer sandwiched between the first layer and the third layer, the first layer, the second layer and the third layer have hardnesses h1, h2 and h3, respectively, and moduli of repulsion elasticity r1, r2 and r3, respectively, which satisfy the following relationships:

$$h1>h2,$$

$$h3>h2,$$

$$r1>r2 \text{ and}$$

$$r3>r2.$$

According to the present invention, a putter type golf club comprises a shaft and the above-mentioned putter type golf club head attached to an end of the shaft.

Further, according to the present invention, the putter type golf club head may have the following optional feature or features:

the hardnesses and the moduli of repulsion elasticity of the first layer and the third layer satisfy the following relationships h1=h3 and r1=r3;

in the face insert, the first layer and the third layer are made of the same material;

in the face insert, only the third layer contacts with the head main body; and the hardnesses of the first layer and the second layer satisfy the following relationship $0<h1-h2\leq 10$ degrees.

In the present invention, the face insert attached to the head main body is formed as a three-layered structure of the first layer, the second layer and the third layer in the order from the face side, and the two relationships a) the hardness of the second layer is less than the hardnesses of the first layer and the third layer and b) the modulus of repulsion elasticity of the second layer is less than the moduli of repulsion elasticity of the first layer and the third layer are satisfied at the same time, therefore, the ball rolling distances and directions can be improved, while ensuring soft impact feelings.

DESCRIPTION OF THE PREFERRED EMBODIMENTS

An embodiment of the present invention will now be described in conjunction with the drawings.

Figure 1:
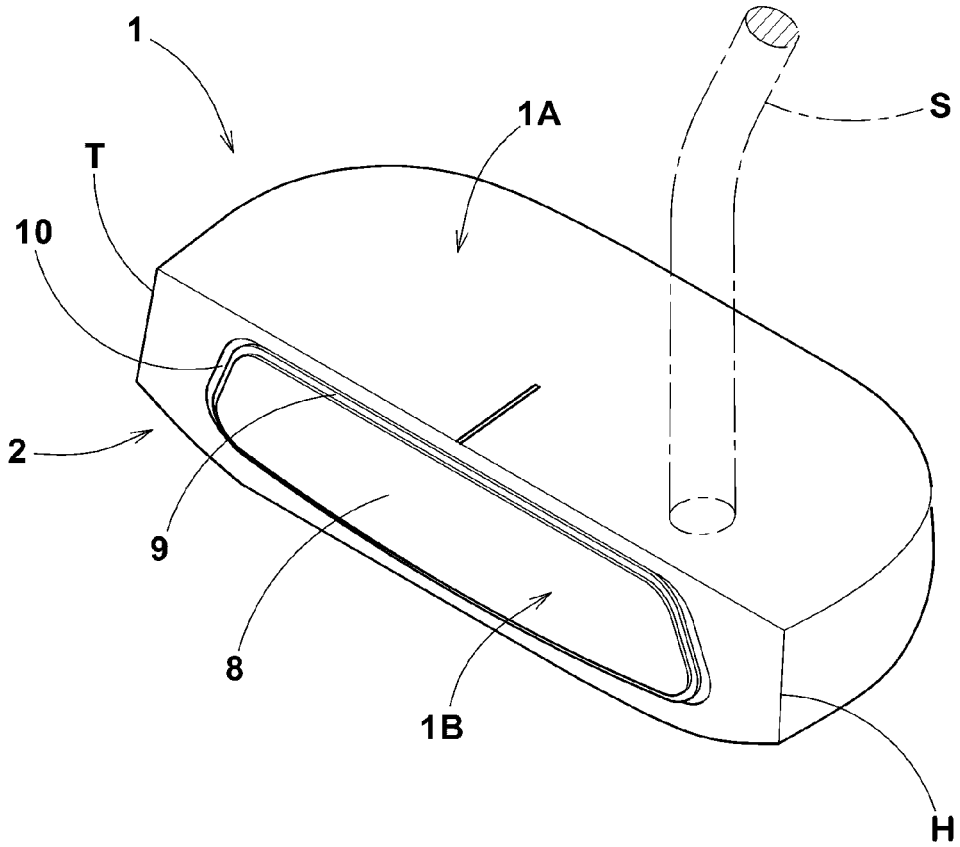
FIG. 1 is a perspective view of a putter type golf club head in this embodiment.
Figure 2:
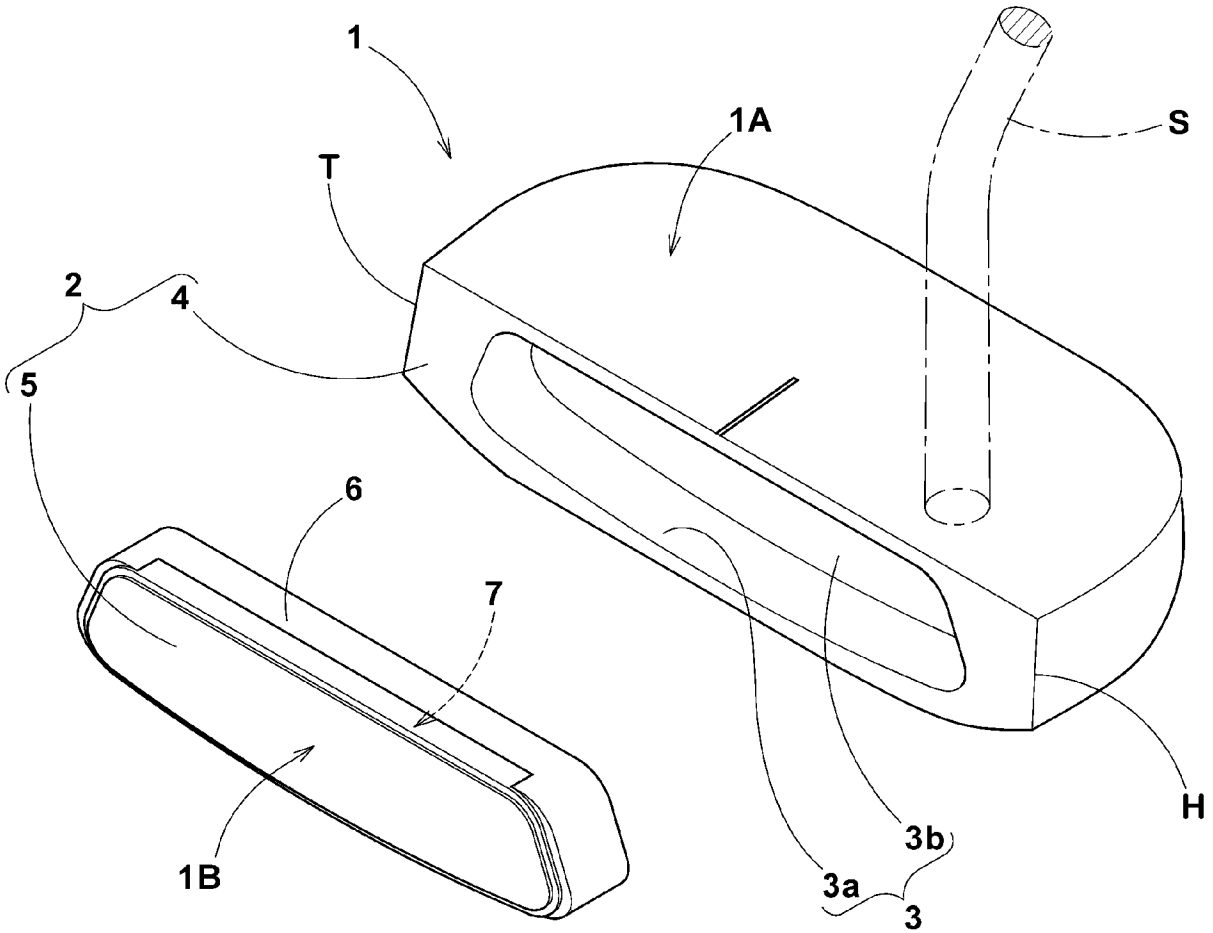
FIG. 2 is an exploded perspective view of FIG. 1.

As shown in FIG. 1 and FIG. 2, a putter type golf club head in this embodiment (hereinafter, simply "putter club head") 1 has a face 2 for hitting a ball on a front side.

The face 2 has a convex shape such that a central part of the face 2 is convex, and is formed in a horizontally-long substantially rectangular shape which is longer in a direction of a toe T and a heel H (horizontal direction).

Further, the face 2 is inclined backward at a small loft angle of 1 to 3 degrees for example.

The putter club head 1 is composed of a head main body 1A provided in a face 2 side with a concave portion 3 and a face insert 1B made of an elastic material attached to the concave portion 3 of the head main body 1A.

The head main body 1A is preferably made of a metal material, e.g. aluminum alloy, stainless steel, titanium, soft iron or the like, and is formed as a substantially flat block extending from an upper edge, lower edge, toe-side edge and heel-side edge of the face 2 toward the respective backwards. The head main body 1A is manufactured by various methods, e.g. casting, forging, machining or the like.

Further, a lower end of a club shaft S is fixed to an upper surface of the head main body 1A for example.

The concave portion 3 is formed to extend over a major part of the face 2 in a toe-heel direction and up-down direction, and has an annular inner circumferential surface 3*a* defining the contour of the concave portion 3, and a bottom face 3*b* closing the inner circumferential surface 3*a* on the inner side of the club head. Such concave portion 3 forms a bottomed space sinking from the face 2.

The concave portion 3 in this embodiment is formed substantially along the contour of the face 2 as a horizontally-long rectangular shape longer in the toe-heel direction. But, it should not be limited to this embodiment.

Incidentally, in the front surface of the head main body 1A and around the concave portion 3, there is formed an annularly continuous front surface edge portion 4.

The face insert 1B is formed as a block having a front surface 5 disposed on a face 2 side to be exposed, a rear surface 7 which is a surface on the opposite side thereof, an outer circumferential surface 6 extending annularly to connect between the front surface 5 and the rear surface 7. The rear surface 7 of the face insert 1B faces the bottom face 3*b* of the concave portion 3, and the outer circumferential surface 6 faces the inner circumferential surface 3*a* of the concave portion 3. In a preferable embodiment, they are arranged to closely contact with each other.

In this embodiment, by attaching the face insert 1B to the concave portion 3 of the head main body 1A, the front surface 5 of the face insert 1B protrudes from the front surface edge portion 4 of the head main body 1A toward the front side, and thus the face insert is convex, and thereby the face 2 is formed. The face insert 1B is fixed to the concave portion 3 of the head main body 1A by the use of a double-sided adhesive tape, adhesive agent or the like. The face 2 is not limited to such embodiment, and it may be formed as a substantially flat single surface.

Figure 3:
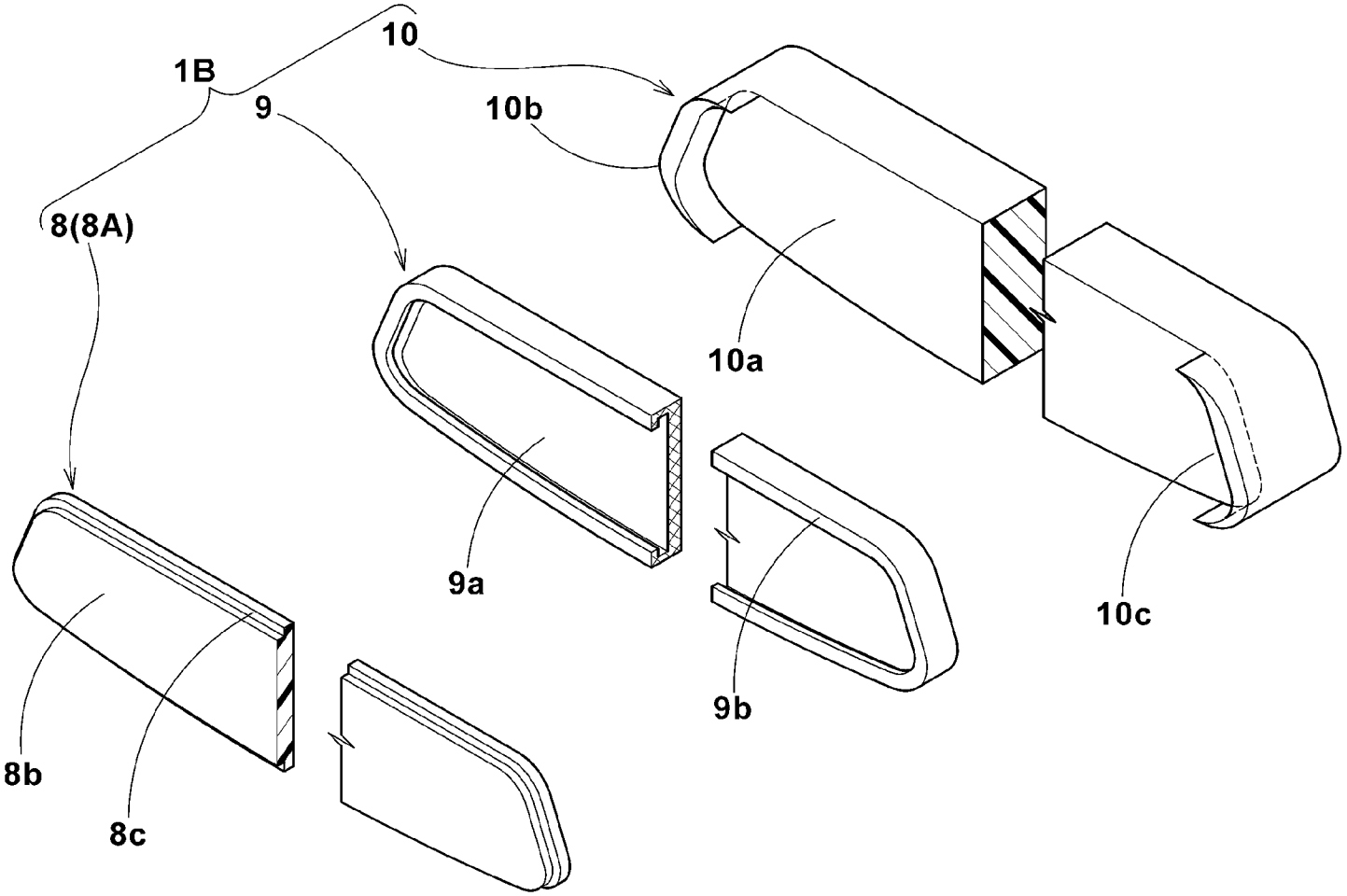
FIG. 3 is an exploded perspective view of the face insert shown in FIG. 2.

As shown in FIG. 3 as an exploded view, the face insert 1B has a three-layered structure made up of a first layer 8 disposed in a frontmost side, a third layer 10 disposed in a rearmost side and a second layer 9 sandwiched between the first layer 8 and the third layer 10.

The present invention is characterized in that hardnesses h1, h2 and h3 and moduli of repulsion elasticity r1, r2 and r3 of the first layer 8, the second layer 9 and the third layer 10, respective, satisfy the following relationships:

$$h1>h2 \text{ and } h3>h2 \quad \text{(a)}$$

$$r1>r2 \text{ and } r3>r2 \quad \text{(b)}$$

Through various test results, the present inventors found that, by satisfying the two relationships a) the hardness of the second layer is less than the hardnesses of the first layer and the third layer and b) the modulus of repulsion elasticity of the second layer is less than the moduli of repulsion elasticity of the first layer and the third layer, it is possible to satisfy both of the ball rolling distance and direction at a higher order while ensuring soft impact feeling. Namely, the present invention is to improve the ball rolling distances and directions while ensuring soft impact feelings by satisfying the above-mentioned two conditions (a) and (b) at the same time.

Especially, by the condition (a), namely by making the intermediary second layer 9 softest and making the first layer 8 and the third layer 10 located in the front side and back side thereof relatively hard, the deflection of the face insert at the time of hitting a ball can be appropriately controlled while maintaining a good impact feeling.

Further, according to the condition (b), by making the modulus of repulsion elasticity of the first layer 8 directly contacting with a ball more than the modulus of repulsion elasticity of the second layer 9, when hitting a ball, the getting away of the ball from the face is accelerated to prevent the occurrence of excess spins, and the directional stability of the ball can be improved and further the rolling of the ball is improved. Furthermore, by making the modulus of repulsion elasticity of the third layer 10 positioned closer to the head main body 1A more than the modulus of repulsion elasticity of the second layer 9, it is facilitated to improve the directional stability and the rolling of the ball while ensuring a vibration absorbing ability.

These functions become apparent from the after-mentioned embodiments.

As to the elastic material used in each of the layers 8-10 of the face insert 1B, a synthetic resin, e.g. ionomer resin, polyurethane resin, polyurethane-based elastomer, polyester-based elastomer, polyamide-based elastomer or the like or a rubber elastic body, e.g. styrene-butadiene rubber, butadiene rubber or the like is preferred.

The shore D hardness h1 of the first layer 8 is preferably 35 to 65 degrees. If the hardness h1 is less than 35 degrees, the deflection of the face insert 1B at the time of hitting a ball becomes large, and the directionality of the ball is liable to deteriorate. If the hardness h1 exceeds 65 degrees, there is a possibility that a soft impact feeling can not be obtained. Especially, it is desirable that the hardness h1 of the first layer 8 is not less than 40 degrees, more preferably not less than 45 degrees. Further, it is preferably not more than 63 degrees, more preferably not more than 60 degrees.

Here, the shore D hardness of the elastic materials is measured in conformity with the provisions of "ASTM-D 2240-68" by the use of an automated rubber hardness measuring tool (Kobunshi Keiki co., Ltd. the trade name "P1") having a Shore D type hardness meter. In the measurement, a sheet of 2 mm thickness made of the same material as a layer of the face insert is used. In advance of the measurement, the sheet is kept at a temperature of 23 degrees c for two weeks. Three sheets are layered at the time of measurement.

It is preferable that the modulus of repulsion elasticity r1 of the first layer 8 is 50% to 70%. If the modulus of repulsion elasticity r1 is less than 50%, there is a possibility that the rolling of the ball is decreased. If the modulus of repulsion elasticity r1 exceeds 70%, the rolling of the ball is excessively increased, and unpleasant vibrations are liable to be transmitted to the player's hands. Especially, it is desirable that the modulus of repulsion elasticity r1 is not less than 53%, preferably not less than 56%. Further, it is preferably not more than 67%, more preferably not more than 63%.

The modulus of repulsion elasticity is obtained through a Lubke repulsion elasticity test (test temperature and humidity are 23 degrees C. and 50 RH %) in conformity with the provisions of "MS K 6255". In the measurement, used is a 2 mm thickness 28 mm diameter disk-shaped slab prepared by hot pressing. At the time of measurement, six slabs are layered. In the measurement, a slab made from identical compositions of the elastic material of each layer of the face insert is used. The slabs are kept at a temperature of 23 degrees C. for two weeks in advance.

As shown in FIG. 3, it is preferable that the thickness D1 of the first layer 8 is 0.3 to 4.0 mm. If the thickness D1 becomes small, there is a possibility that sufficient soft impact feelings can not be obtained. If the thickness D1 becomes large, the deflected part becomes broad, and there is a possibility that the ball's directionality deteriorates. Especially, it is desirable that the thickness D1 is not less than 0.5 mm, preferably not less than 0.8 mm. Further, it is preferably not more than 3.8 mm, more preferably not more than 3.5 mm.

If the thickness of each layer of the face insert 1B is not constant, the above-mentioned thickness is a minimum thickness occurring in a central region in the toe-heel direction which most frequently contacts with balls directly or indirectly.

The shore D hardness h2 of the second layer 9 is set to be less than the hardnesses h1 and h3 of the first layer 8 and the third layer 10 as noted above, and preferably 30 to 60 degrees.

If the hardness h2 is less than 30 degrees, the deflection of the first layer 8 at the time of hitting a ball can not be suppressed, and there is a possibility that the directionality of the ball deteriorates. If exceed 60 degrees, there is a possibility that soft impact feelings can not be obtained. Especially, it is desirable that the Shore D hardness h2 of the second layer 9 is not less than 35 degrees, more preferably not less than 40 degrees. Further, it is preferably not more than 57 degrees, more preferably not more than 55 degrees.

In order to effectively derive the above-mentioned functions, the difference h1-h2 between the Shore D hardness h2 of the second layer 9 and the Shore D hardness h1 of the first layer 8 is preferably not more than 10 degrees.

It is preferable that the modulus of repulsion elasticity r2 of the second layer 9 is 30 to 60%. If the modulus of repulsion elasticity r2 is less than 30%, the deflection of the face insert at the time of hitting a ball becomes excessively large and impact feelings become hard to reach to the player's hands. Further, it becomes difficult to have a clue about distance. If the modulus of repulsion elasticity r2 exceeds 60%, there is a possibility that unpleasant vibrations at impact are liable to be transmitted to the player's hands. Especially, it is desirable that the modulus of repulsion elasticity r2 of the second layer 9 is not less than 33%, preferably not less than 35%. Further, it is preferably not more than 50%, more preferably not more than 40%.

Further, it is beneficial that the thickness D2 of the second layer 9 is 1.0 to 5.0 mm. If the thickness D2 is less than 1.0 mm, there is a possibility that soft impact feelings can not be obtained. If the thickness D2 exceeds 5.0 mm, the deflection of the first layer 8 can not be suppressed, and there is a possibility that the directionality of the ball deteriorates. Especially, it is desirable that the thickness D2 of the second layer 9 is not less than 1.2 mm, more preferably not less than 1.5 mm. Further, it is preferably not more than 4.8 mm, more preferably not more than 4.5 mm.

It is preferable that the shore D hardness h3 of the third layer 10 is 35 to 65 degrees. If the hardness h3 is less than 35 degrees, the deflection of the face insert 1B at the time of hitting a ball becomes large, and there is a possibility that the directionality of the ball is deteriorated. If the hardness h3 exceeds 65 degrees, there is a possibility that soft impact feelings can not be obtained. Especially, it is desirable that the Shore D hardness h3 of the third layer 10 is not less than 40 degrees, more preferably not less than 45 degrees. Further, it is preferably not more than 63 degrees, more preferably not more than 60 degrees.

It is preferable that the modulus of repulsion elasticity r3 of the third layer 10 is 50 to 70%. If the modulus of repulsion elasticity r3 is less than 50%, the deflection of the face insert becomes large and impact feelings become hard to reach to the player's hands and it becomes difficult to have a clue about distance. If exceeds 70%, there is a possibility that vibrations at impact can not be absorbed sufficiently. Especially, it is desirable that the modulus of repulsion elasticity r3 is not less than 53%, more preferably not less than 57%. Further, it is preferably not more than 67%, more preferably not more than 63%.

It is preferable that the thickness D3 of the third layer 10 is 1.0 to 5.0 mm. If the thickness D3 is less than 1.0 mm, there is a possibility that soft impact feelings can not be obtained. If exceeds 5.0 mm, the part deflected when hitting a ball becomes broad, and there is a possibility that the impact feelings become excessively soft. Especially, it is desirable that the thickness D3 of the third layer 10 is not less than 1.5 mm, more preferably not less than 2.0 mm. Further, it is preferably not more than 4.5 mm, more preferably not more than 4.0 mm.

In order to effectively derive the above-mentioned functions, it is preferable that the Shore D hardness h1 of the first layer 8 is equal to the shore D hardness h3 of the third layer 10, and the modulus of repulsion elasticity r1 of the first layer 8 is equal to the modulus of repulsion elasticity r3 of the third layer 10. Especially, it is desirable that the first layer 8 and the third layer 10 are made of identical materials.

Further, as shown in FIG. 3, the first layer 8 in this embodiment is formed as a convex part 8A which has a thick part 8*b* extending in the toe-heel direction and formed in a center side, and a thin part 8*c* continuously surrounding the thick part 8*b* and having a thickness less than the thick part 8*b*.

The second layer 9 in this embodiment is composed of a plate-like basal portion 9*a* and an L-shaped flange portion 9*b* protruding forward from the outer circumference of the basal portion 9*a* and bent toward the inside of the basal portion 9*a*. The thin part 8*c* of the first layer 8 continuously contacts with the inside surface of the flange portion 9*b*.

Such second layer 9 is preferable in that it can absorb and damp vibration components in multi directions including vibrations of the first layer 8 in the front-back direction as well as vibrations in the up-down and toe-heel directions.

The third layer 10 in this embodiment is composed of a plate-like basal portion 10*a*, a toe-side flange 10*b* protruding forward from the front surface of the basal portion 10*a* on a toe T side to coverer the outer circumferential surface of the second layer 9, and a heel-side flange 10*c* protruding forward from the front surface of the basal portion 10*a* on a heel H side to cover the outer circumferential surface of the second layer 9.

Such third layer 10 is also preferable in that it can absorb and damp vibration components in multi directions including vibrations of the first layer 8 and the second layer 9 in the toe-heel direction.

Figure 4:
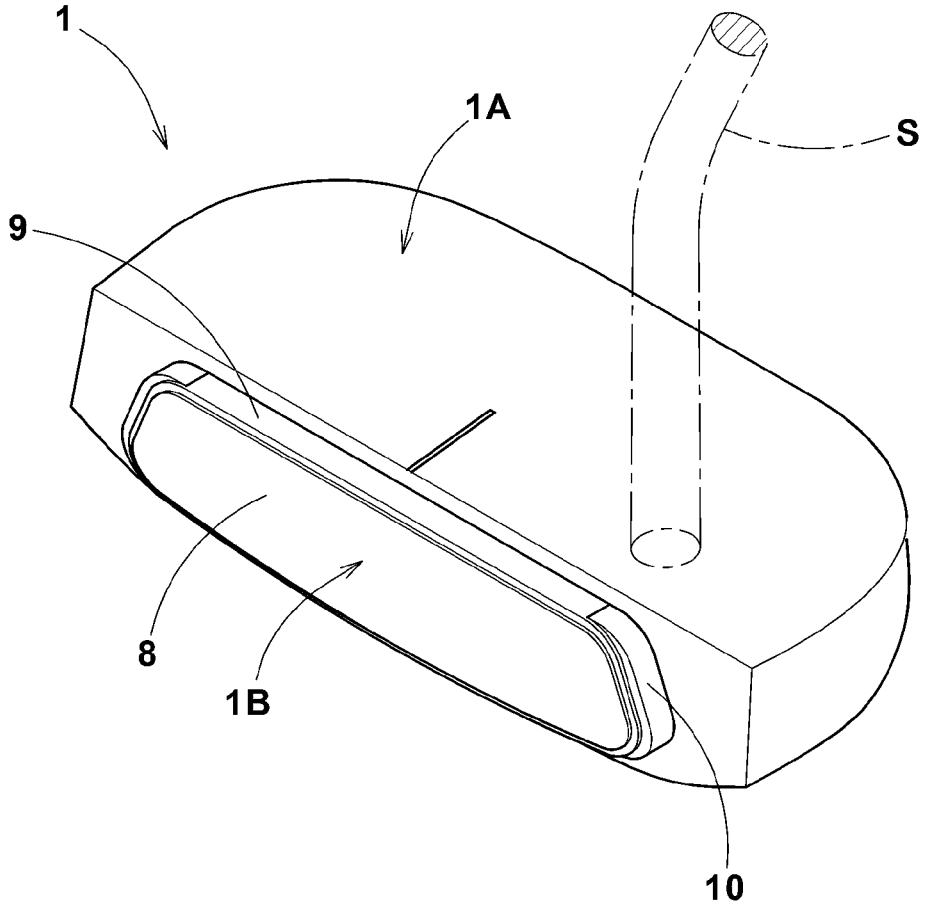
FIG. 4 is a perspective view of a putter type golf club head in another embodiment.

Further, another embodiment of the present invention is show in FIG. 4. In this embodiment, only the third layer 10 contacts with the inner circumferential surface 3*a* of the concave portion 3 of the head main body 1A. In such putter club head 1, as the ball hitting positions get away from the club shaft S, vibration components are further absorbed and damped, therefore more soft impact feeling can be obtained.

While an especially preferred embodiment of the present invention has been described, the present invention may be embodied variously without limited to the embodiments shown in the drawings.

Comparison Tests

In order to confirm effects of the present invention, putter type golf club heads having the basic shape shown in FIG. 1 were attached to shafts, and putter type golf clubs having an overall length of 34 inches were produced experimentally and actual hitting tests were carried out.

The head main body was a casting of sus630.

The face insert had the basic shape shown in FIG. 2, wherein the thickness of the flange portion of the second layer was 1 mm, and the thickness of the flange portion of the third layer was 2 mm at the maximum position.

In the actual hitting test, by the use pf commercially available three-piece golf balls (Z-UR) manufactured by SRI sports Limited, ten golfers hit putts from six meters repeatedly five times. As to the impact feeling, vibrations transmitted to the hands and the degree of hardness when hitting putts were evaluated by feelings of each golfer on the following basis, and overall averages were obtained as test results. The larger the value, the better the impact feeling.

Figure 5:
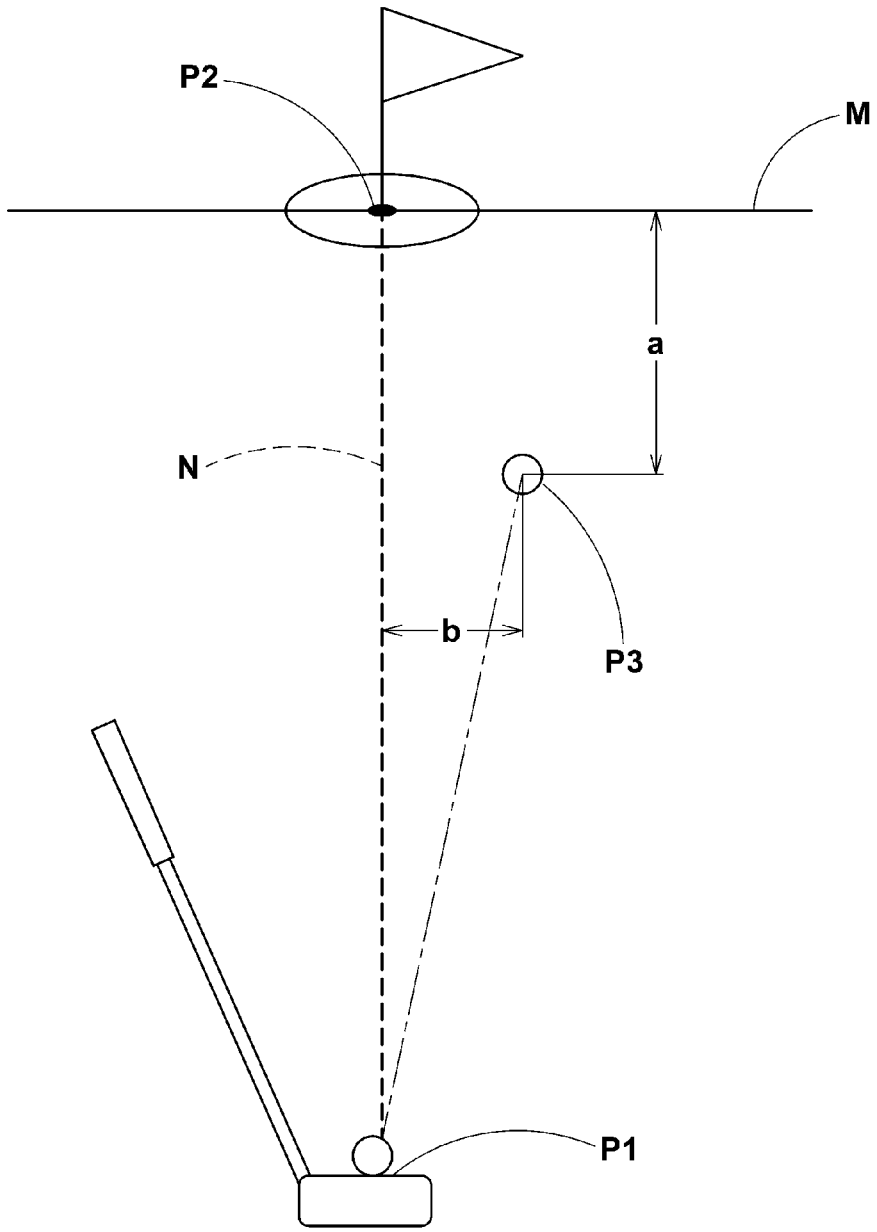
FIG. 5 is a diagram showing the way of an actual hitting test.

<Impact Feeling (Hardness)>
point 5—very soft
point 4—soft
point 3—average (comparative example 1 is standard)
point 2—hard
point 1—very hard
<Impact Feelings (Vibration)>
point 5—vibrations transmitted to hands are very small
point 4—vibrations transmitted to hands are small
point 3—average (comparative example 1 is standard)
point 2—vibrations transmitted to hands are large
point 1—vibrations transmitted to hands are very large Further, as shown in FIG. 5, the lateral deviation (b) of the stop position P3 of the ball from a longitudinal line N drawn between the ball launching position P1 and the target position P2, and the longitudinal deviation (a) of the ball stop position P3 from a lateral line M passing through the target position P2 perpendicularly to the longitudinal line N were measured. In the evaluations, the average lateral deviation and average longitudinal deviation were obtained by respectively averaging the lateral deviation (b) and the longitudinal deviation (a) over the ten golfers, and indicated by an index based on comparative example 1 being 1. The larger value means the larger deviation and worse performance.

The test results and the like are shown in Table 1.

TABLE 1

| | | comparative example 1 | comparative example 2 | comparative example 3 | comparative example 4 | comparative example 5 |
|---|---|---|---|---|---|---|
| | number of layers of face insert | 1 | 2 | 2 | 2 | 2 |
| First | material | TPU | TPU | TPU | TPU | PEBAX |
| layer | hardness h1 (Shore D) | 55 | 55 | 55 | 55 | 63 |
| | modulus of repulsion elasticity r1 (%) | 35 | 35 | 35 | 35 | 56 |
| | thickness D1 (mm) | 6 | 6 | 6 | 6 | 4 |
| Second | material | — | PEBAX | PEBAX | PEBAX | TPU |
| layer | hardness h2 (Shore D) | — | 63 | 55 | 40 | 55 |
| | modulus of repulsion elasticity r2 (%) | — | 56 | 59 | 63 | 35 |
| | thickness D2 (mm) | — | 4 | 2 | 2 | 6 |
| Third | material | — | — | — | — | — |
| layer | hardness h3 (Shore D) | — | — | — | — | — |
| | modulus of repulsion elasticity r3 (%) | — | — | — | — | — |
| | thickness D3 (mm) | — | — | — | — | — |
| Test | impact feeling (hardness) | 3.0 | 2.4 | 3.1 | 3.4 | 2.3 |
| results | impact feeling (vibration) | 3.0 | 2.3 | 2.7 | 2.9 | 2.9 |
| | sum of evaluations of impact feelings | 6.0 | 4.7 | 5.8 | 6.3 | 5.2 |
| | longitudinal deviation index | 1.0 | 1.4 | 1.2 | 1.3 | 1.1 |
| | lateral deviation index | 1.0 | 0.9 | 1.2 | 1.4 | 1.1 |
| | sum of deviation indexes | 2.0 | 2.3 | 2.4 | 2.7 | 2.2 |
| | remarks on performance evaluations | | since second layer was hard, impact feeling was hard | since modulus of repulsion elasticity of second layer was large, deviation was large | since modulus of repulsion elasticity of second layer was large, deviation was large | there was no third layer, impact feeling was hard |

| | | Embodiment 1 | Embodiment 2 | Embodiment 3 | Embodiment 4 | Embodiment 5 | Embodiment 6 |
|---|---|---|---|---|---|---|---|
| | number of layers of face insert | 3 | 3 | 3 | 3 | 3 | 3 |
| First | material | PEBAX | PEBAX | PEBAX | PEBAX | PEBAX | TPU |
| layer | hardness h1 (Shore D) | 55 | 63 | 63 | 63 | 55 | 55 |
| | modulus of repulsion elasticity r1 (%) | 59 | 56 | 56 | 56 | 59 | 35 |
| | thickness D1 (mm) | 2 | 4 | 4 | 4 | 2 | 6 |
| Second | material | TPU | TPU | TPU | TPU | TPU | TPU |
| layer | hardness h2 (Shore D) | 45 | 45 | 55 | 40 | 45 | 45 |
| | modulus of repulsion elasticity r2 (%) | 30 | 30 | 36 | 30 | 30 | 30 |
| | thickness D2 (mm) | 2 | 2 | 6 | 2 | 2 | 2 |
| Third | material | PEBAX | PEBAX | PEBAX | PEBAX | TPU | TPU |
| layer | hardness h3 (Shore D) | 55 | 63 | 63 | 55 | 55 | 55 |
| | modulus of repulsion elasticity r3 (%) | 59 | 56 | 56 | 59 | 35 | 35 |
| | thickness D3 (mm) | 2 | 4 | 4 | 2 | 6 | 6 |
| Test | impact feeling (hardness) | 4.1 | 3.7 | 3.2 | 3.4 | 3.2 | 3.1 |
| results | impact feeling (vibration) | 3.9 | 3.6 | 3.4 | 3.5 | 3.5 | 3.5 |
| | sum of evaluations of impact feelings | 8.0 | 7.3 | 6.6 | 6.9 | 6.7 | 6.6 |
| | longitudinal deviation index | 0.8 | 0.7 | 0.8 | 0.9 | 0.9 | 1.1 |
| | lateral deviation index | 0.7 | 0.8 | 0.9 | 1.0 | 1.1 | 1.1 |
| | sum of deviation indexes | 1.5 | 1.5 | 1.7 | 1.9 | 2.0 | 2.2 |
| | remarks on performance evaluations | | | | | | |

| | | comparative example 6 | comparative example 7 | comparative example 8 |
|---|---|---|---|---|
| | number of layers of face insert | 3 | 3 | 3 |
| First | material | PEBAX | TPU | PEBAX |
| layer | hardness h1 (Shore D) | 55 | 65 | 40 |
| | modulus of repulsion elasticity r1 (%) | 59 | 40 | 63 |
| | thickness D1 (mm) | 2 | 2 | 2 |

TABLE 1-continued

| | | | | |
|---|---|---|---|---|
| Second layer | material | TPU | PEBAX | TPU |
| | hardness h2 (Shore D) | 55 | 63 | 45 |
| | modulus of repulsion elasticity r2 (%) | 35 | 56 | 30 |
| | thickness D2 (mm) | 6 | 4 | 2 |
| Third layer | material | PEBAX | TPU | PEBAX |
| | hardness h3 (Shore D) | 55 | 65 | 40 |
| | modulus of repulsion elasticity r3 (%) | 59 | 40 | 63 |
| | thickness D3 (mm) | 2 | 2 | 2 |
| Test results | impact feeling (hardness) | 3.0 | 1.9 | 2.8 |
| | impact feeling (vibration) | 3.1 | 2.7 | 3.0 |
| | sum of evaluations of impact feelings | 6.1 | 4.6 | 5.8 |
| | longitudinal deviation index | 1.1 | 1.4 | 1.1 |
| | lateral deviation index | 1.4 | 1.5 | 1.2 |
| | sum of deviation indexes | 2.5 | 2.9 | 2.3 |
| | remarks on performance evaluations | since first layer-third layer had same hardness, impact feeling was hard | since hardness of second layer was excessively large, impact feeling was very hard | since hardness of second layer was larger than first layer and third layer, impact feeling was hard |

| | | comparative example 9 | comparative example 10 |
|---|---|---|---|
| | number of layers of face insert | 3 | 3 |
| First layer | material | PEBAX | PEBAX |
| | hardness h1 (Shore D) | 63 | 63 |
| | modulus of repulsion elasticity r1 (%) | 56 | 56 |
| | thickness D1 (mm) | 4 | 4 |
| Second layer | material | PEBAX | PEBAX |
| | hardness h2 (Shore D) | 55 | 55 |
| | modulus of repulsion elasticity r2 (%) | 59 | 59 |
| | thickness D2 (mm) | 2 | 2 |
| Third layer | material | PEBAX | TPU |
| | hardness h3 (Shore D) | 63 | 65 |
| | modulus of repulsion elasticity r3 (%) | 56 | 40 |
| | thickness D3 (mm) | 4 | 2 |
| Test results | impact feeling (hardness) | 2.5 | 2.4 |
| | impact feeling (vibration) | 3.6 | 3.2 |
| | sum of evaluations of impact feelings | 6.1 | 5.6 |
| | longitudinal deviation index | 1.3 | 1.3 |
| | lateral deviation index | 1.2 | 1.4 |
| | sum of deviation indexes | 2.5 | 2.7 |
| | remarks on performance evaluations | since modulus of repulsion elasticity of second layer was larger than first layer and third layer, vibrations were large | since modulus of repulsion elasticity of second layer was larger than first layer and third layer, vibrations were large |

The codes used in Table 1 for the materials of the face inserts are as follows.

PEBAX: Polyether block amide (manufacturer: Arkema inc.)

TPU: Thermoplastic polyurethane resin (product name: Elastollan 11 TYPE, BASF)

From the test results, it was confirmed that the putter type golf clubs as Embodiments were decreased in the deviations, and the ball rolling distance and direction were maintained at high levels. Further, with respect to the impact feelings, good results could be obtained.

The invention claimed is:

1. A putter type golf club head having a face for hitting a ball on a front side, wherein the head has a head main body made of a metal material provided in a face side with a concave portion, and a face insert attached to the concave portion of the head main body, the face insert has a three-layered structure made up of a first layer disposed in a frontmost side, a third layer disposed in a rearmost side and a second layer sandwiched between the first layer and the third layer, wherein each of the first, second and third layers is made of a synthetic resin or alternatively a rubbery elastomer, and the first layer, the second layer and the third layer have hardnesses h1, h2 and h3, respectively, and moduli of repulsion elasticity r1, r2 and r3, respectively, which satisfy the following relationships:

$$h1>h2,$$

$$h3>h2,$$

$$r1>r2 \text{ and}$$

$$r3>r2$$

wherein the hardness is Shore D hardness measured according to ASTM-D2240-68 "Standard Test Method for Rubber Property-Durometer Hardness", and the modulus of repulsion elasticity is measured at a temperature of 23 degrees C. and a humidity of 50 RH % according to Japanese Industrial Standard K6255 "Rubber, vulcanized or thermoplastic—Determination of rebound resilience".

2. The putter type golf club head according to claim 1, wherein the hardnesses and the moduli of repulsion elasticity of the first layer and the third layer satisfy the following relationships:

$$h1=h3 \text{ and}$$

$$r1=r3.$$

3. The putter type golf club head according to the claim 1, in which, in the face insert, the first layer and the third layer are made of the same material.

4. The putter type golf club head according to claim 1, in which, in the face insert, only the third layer contacts with the head main body.

5. The putter type golf club head according to claim 1, in which the hardnesses of the first layer and the second layer satisfy the following relationship:

$$0<h1-h2<10 \text{ degrees.}$$

6. The putter type golf club head according to claim 1, wherein the Shore D hardness of the first layer is 35 to 65 degrees.

7. The putter type golf club head according to claim 1, wherein the Shore D hardness of the first layer is not less than 40 degrees and not more than 63 degrees.

8. The putter type golf club head according to claim 1, wherein the modulus of repulsion elasticity r1 of the first layer is 50% to 70%.

9. The putter type golf club head according to claim 1, wherein the modulus of repulsion elasticity r1 of the first layer is not less than 53% and not more than 67%.

10. The putter type golf club head according to claim 1, wherein the thickness of the first layer is 0.3 to 4.0 mm.

11. The putter type golf club head according to claim 1, wherein the Shore D hardness of the second layer is 30 to 60 degrees.

12. The putter type golf club head according to claim 1, wherein the Shore D hardness of the second layer is not less than 35 degrees and not more than 57 degrees.

13. The putter type golf club head according to claim 1, wherein the modulus of repulsion elasticity r2 of the second layer is 30 to 60%.

14. The putter type golf club head according to claim 1, wherein the modulus of repulsion elasticity r2 of the second layer is not less than 33% and not more than 50%.

15. The putter type golf club head according to claim 1, wherein the thickness of the second layer is 1.0 to 5.0 mm.

16. The putter type golf club head according to claim 1, wherein the Shore D hardness of the third layer s 35 to 65 degrees.

17. The putter type golf club head according to claim 1, wherein the Shore D hardness of the third layer is not less than 40 degrees and not more than 63 degrees.

18. The putter type golf club head according to claim 1, wherein the modulus of repulsion elasticity r3 of the third layer is 50 to 70%.

19. The putter type golf club head according to claim 1, wherein the thickness of the third layer is 1.0 to 5.0 mm.

20. A putter type golf club comprising a shaft and the putter type golf club head according to claim 1.

* * * * *